United States Patent [19]

Kochauf

[11] 4,209,921

[45] Jul. 1, 1980

[54] FLAT IRON FOIL

[76] Inventor: Josef Kochauf, Berg Am Laimstrasse 89, Munich, Fed. Rep. of Germany

[21] Appl. No.: 876,624

[22] Filed: Feb. 10, 1978

Related U.S. Application Data

[63] Continuation-in-part of Ser. No. 756,444, Apr. 21, 1977, abandoned.

[30] Foreign Application Priority Data

Dec. 31, 1976 [CA] Canada ..... 269050

[51] Int. Cl.[2] ..... D06F 75/20; D06F 75/38

[52] U.S. Cl. ..... 38/97

[58] Field of Search ..... 38/81, 97, 77.83, 77.9

[56] References Cited

U.S. PATENT DOCUMENTS

| | | | |
|---|---|---|---|
| 1,725,841 | 8/1929 | Woodman | 38/97 |
| 2,876,565 | 3/1959 | Jacobson | 38/97 |
| 3,257,746 | 6/1966 | Cohen | 38/97 |
| 3,260,005 | 7/1966 | Loomis | 38/77.9 X |
| 3,404,471 | 10/1968 | Wilsker et al. | 38/97 |

*Primary Examiner*—Louis Rimrodt
*Attorney, Agent, or Firm*—J. Harold Nissen

[57] ABSTRACT

This invention relates to a boot or covering to be removably secured to the bottom of an iron such as one would use to remove wrinkles from newly washed clothing, to give the iron improved characteristics with respect to its use for ironing heat-sensitive materials. The boot or covering comprises a perforated sheet of material such as the polytetrafloroethylene material available under such tradenames as Teflon, or similar materials having a width sufficient to form a rippled or wave-like folded side border of sufficient size to facilitate securing the boot to the bottom of an iron by wrapping it partially about the iron. Ridges are provided at or near the openings to form steam distribution conduits. Metal edged holes are provided along the edges of the material to allow a coiled spring or other similar device to be secured to the sheet without damaging the sheet while holding it to the iron. The front of the sheet is formed with flaps or corners which can be overlapped and form a pocket to hold the nose of the iron.

10 Claims, 11 Drawing Figures

FIG. 1
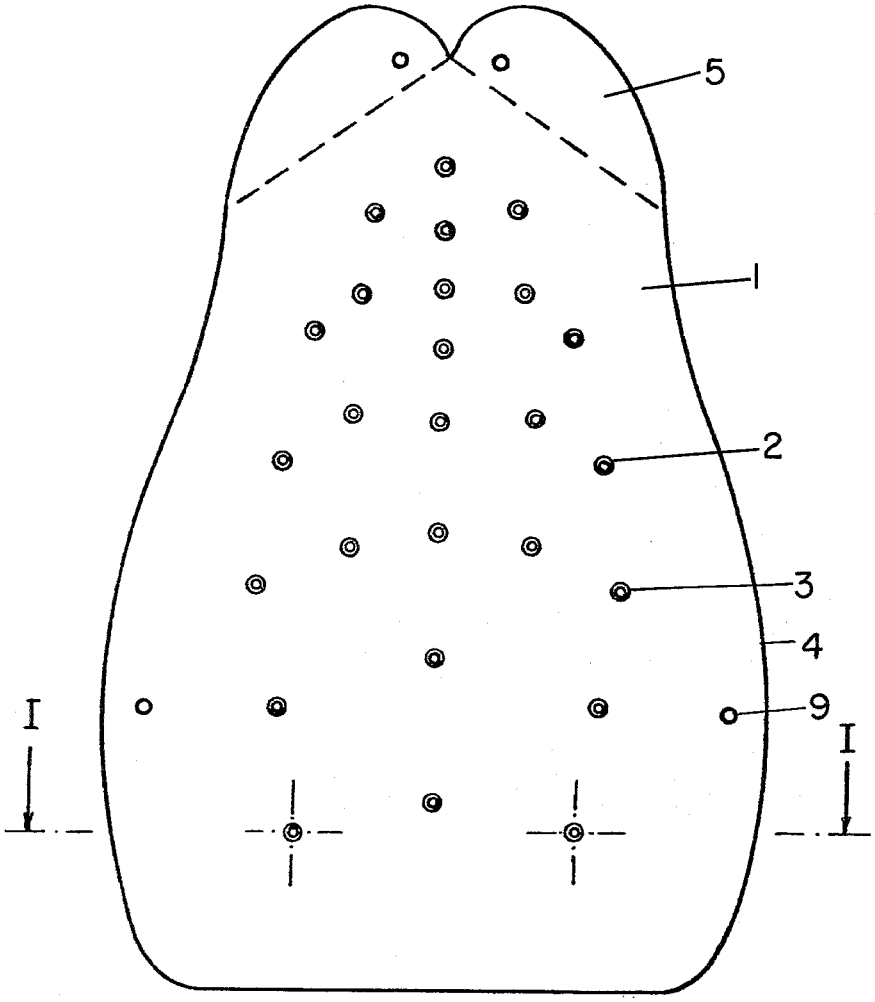
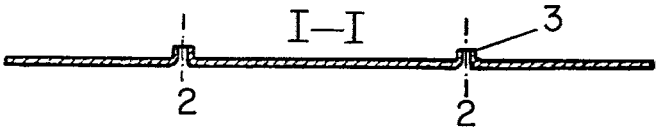
FIG. 2

III - III

IV - IV

V - V

FLAT IRON FOIL

This is a continuation-in-part of Application Ser. No. 756,444, filed Apr. 21, 1977, now abandoned.

BACKGROUND OF THE INVENTION

In the past there have been proposed shoes or covers attachable to the under side of the sole of a steam or flat iron and so shaped as to substantially conform to the sole of the iron. However, it has been found that those boots suffer from disadvantages. They are closely mounted to the sole of the iron and the perforated openings in the boot do not normally align with the steam openings in the iron sole. This prevents proper steaming of the clothes or other material being ironed. Additionally, the material forming the prior boots is often framed by a metal frame and has no way of expansion.

It is therefore an object of the present invention to provide a thin boot or cover for an iron which overcomes the disadvantages of prior boots.

It is further an object of the present invention to provide a thin boot of one-piece construction which may be readily and inexpensively constructed.

These and other objects and advantages of the present invention will be understood when considered with the following description taken in connection with the accompanying drawings made a part of this application. The device of the present invention is by no means limited to the specific embodiments illustrated in drawings since they are shown merely for purposes of description.

BRIEF DESCRIPTION

The objects of the present invention are accomplished by providing ridges in a perforated material boot to space the boot apart from the iron and simultaneously provide steam distribution passages to the perforations. Soft sides and a spring biasing means hold the boot to the iron and compensate for expansion of the boot due to heating or stretching.

BRIEF DESCRIPTION OF THE DRAWINGS

FIG. 1 is a plan view of the sheet boot in one piece.

FIG. 2 is a sectional view of the sheet boot taken on the line of line I-I of FIG. 1.

DESCRIPTION OF THE PREFERRED EMBODIMENTS

In FIG. 1 is shown a sheet boot device 1 punched in one piece of Teflon or other suitable iron covering material. It is perforated with openings 2 having collars 3 on the inside of the sheet boot. Preferably the sheet is wider than the iron sole surface so that the edges will fold up about the sides of the iron with an edge 4 forming "wavelike" or "corrugated" sides when wrapped about the iron. This width permits compensation for the different reactions to heat or other expansion/contraction forces of the iron and the boot or cover.

Figure 5:
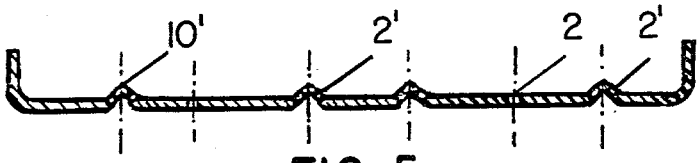
FIG. 5 is a sectional view of a sheet boot with ridges having side holes and openings in the bottom of the sheet.
Figure 6:
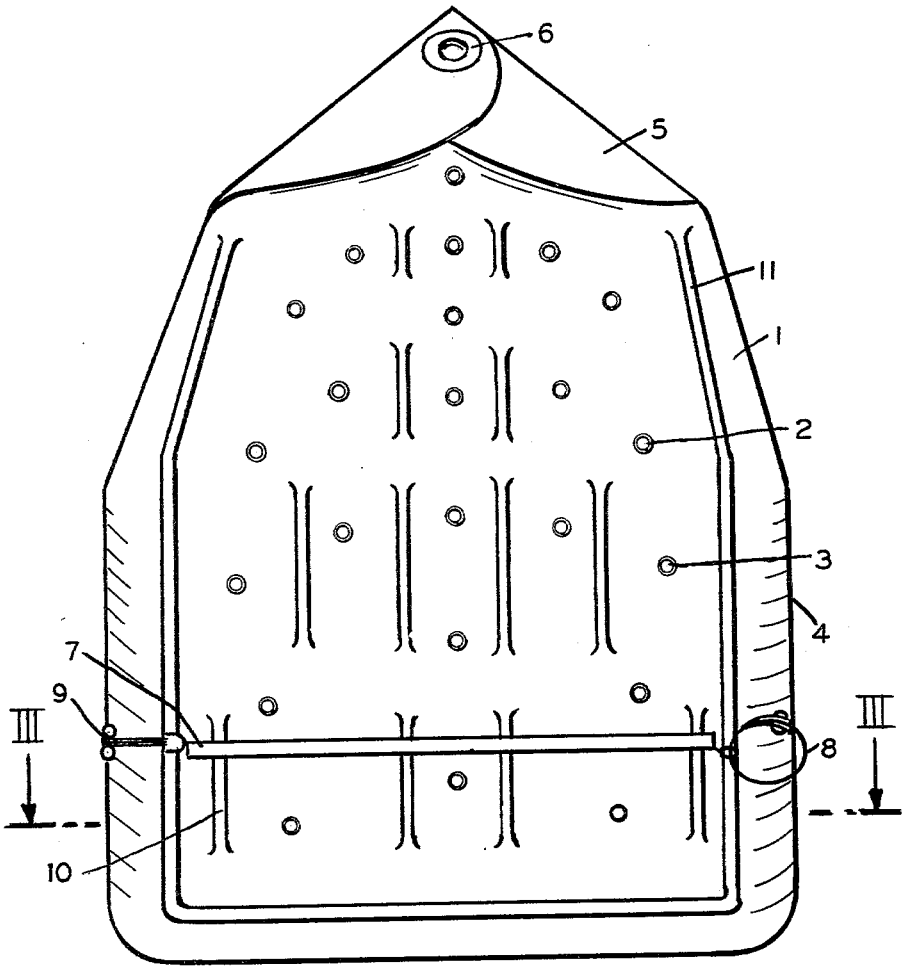
FIG. 6 is a plan view of the sheet boot similar to FIG. 3, showing an embodiment thereof.
Figure 7:
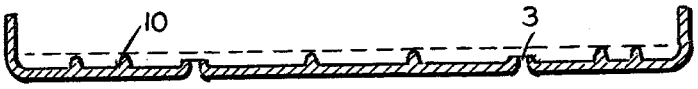
FIG. 7 is a sectional view of the sheet boot taken on the line III—III of FIG. 6.

In FIG. 2 is a sectional view taken on the line I—I in FIG. 1. The openings 2 are shown vertically disposed and are outwardly enlarged. Alternatively, collars 3 can be provided with side openings as shown in FIG. 5.

Figure 3:
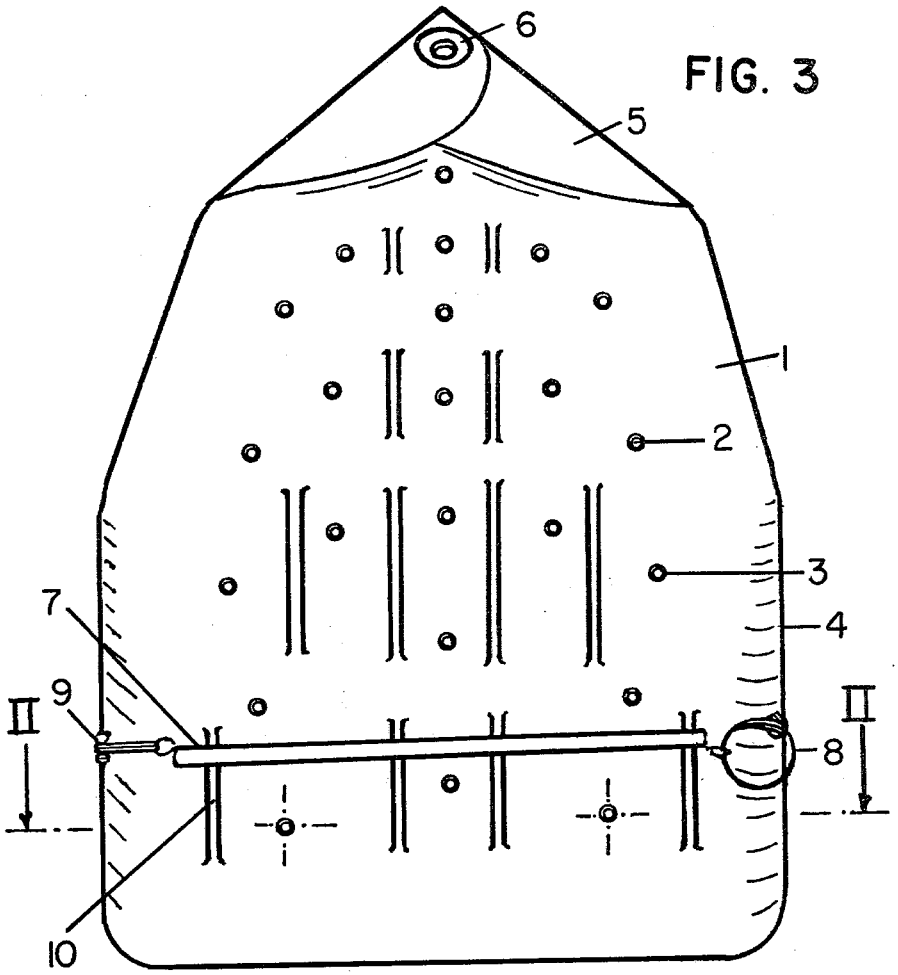
FIG. 3 is a plan view of the sheet boot with overlapped front parts and a coiled spring connected to side parts.

Flaps or corners 5 are provided at one end of the boot, as shown in FIG. 1. In use, the flaps or corners 5 are overlapped, as shown in FIG. 3 to form a nose or pocket 6.

To provide for an even distribution of steam from the sole of the iron to the perforations in the cover or boot, the cover or boot 1 is provided with ridges 10, which form channels therebetween for the openings 2.

The inside collars 3 are preferably made of small ring-like pieces punched out of the sheet material. When in place, they are lower than the ridges 10 as shown in FIGS. 4, 5, 7, and 11, allowing steam passage.

In order to secure the device to an iron, openings 9, preferably metal reinforced to protect the cover material, are provided near the edge of the device. A biasing means such as coiled spring 7 may be secured directly to a hole 9 on one side of the device, and removably secured, by means of a fastening ring 8, to a second hole 9 on the other side of the device. This is a simple effective and inexpensive construction which keeps the cover or boot 1 smooth and tight across the bottom of the iron. Additionally, the construction allows one size boot or cover 1 to be effective for use with various sized irons having varying steam hole patterns.

Figure 4:
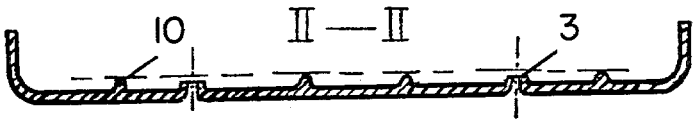
FIG. 4 is a sectional view of the sheet boot taken on the line II—II in FIG. 3.

FIG. 4 shows a sectional view taken on the line II—II in FIG. 3. As mentioned the collars 3 are lower than the ridges 10. The steam holes 2 are shown bevelled outwardly to enable a quicker and more even distribution of the heat over the surface to be ironed.

Figure 8:
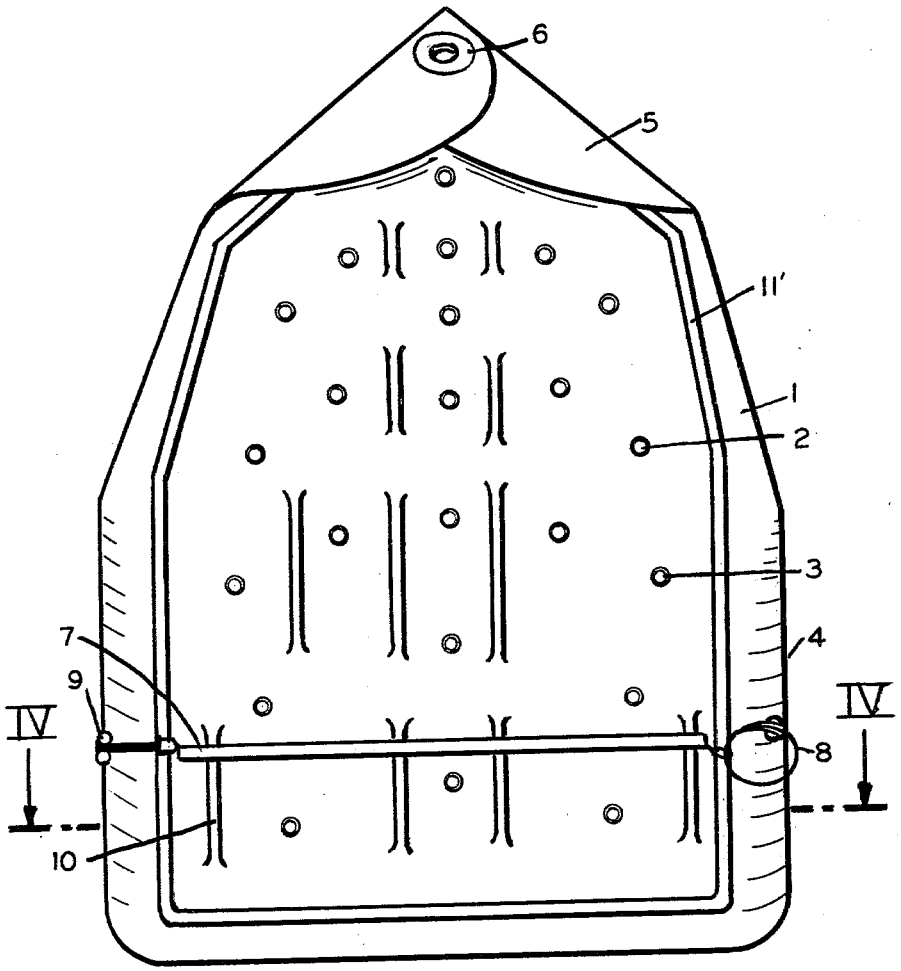
FIG. 8 is a plan view of the sheet boot similar to FIG. 3, showing an embodiment thereof.
Figure 9:
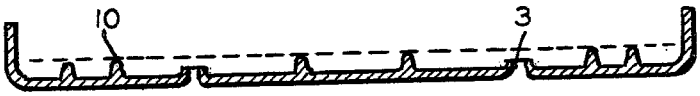
FIG. 9 is a sectional view of the sheet boot taken on the line IV—IV of FIG. 6.
Figure 10:
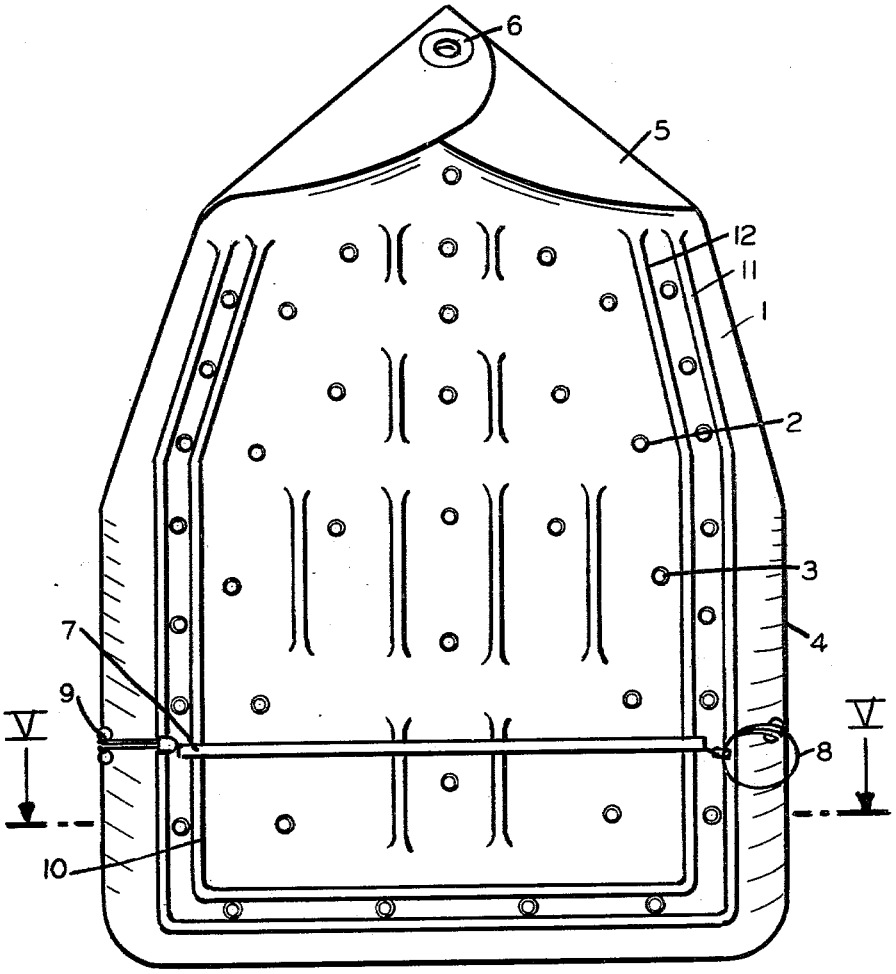
FIG. 10 is a plan view of the sheet boot similar to FIG. 3, showing an embodiment thereof.
Figure 11:
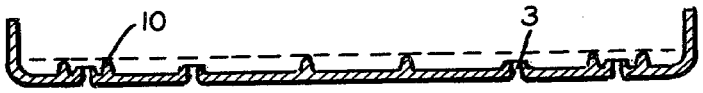
FIG. 11 is a sectional view of the sheet boot taken on the line V—V of FIG. 6.

In order to improve still further the characteristics of the iron cover or boot 1 of the present invention, it has been found that providing an additional ridge 11 (FIGS. 6–9) or ridges 11, 12 (FIGS. 10, 11) around the periphery of the device results in quicker ironing due to the capture of steam between the cover and the material being ironed. The peripheral ridge 11 in FIG. 8 completely circumscribes the cover 1.

Where parallel ridges 11, 12 are utilized, additional steam holes 2 may be added.

A boot, according to the present invention, is particularly useful when heat sensitive materials, such as nylon and other "silky" fabrics made of artificial polymer materials, are to be ironed. The capture of steam by the boot or cover attached to the bottom of the iron, in combination with the material of which the boot itself is fabricated, causes a reduction in ironing friction and an improvement in general effectiveness of the combination for removal of wrinkles from material being ironed. Additionally, as can readily be realized, as the boot or cover is supported in a spaced apart relationship with the sole of the iron, there is a spreading out or evening out of the heat provided by the iron. This reduces the effect of hot spots and, to some extent, the use of too high a temperature of the iron for the material being ironed, whereby the possibility of damage to the material being ironed, such as by melting or scorching, is greatly reduced.

The material being ironed is also, to some extent, protected from possible water spotting caused by water spurting from the steam holes of the iron such as sometimes occurs especially during the initial heating up of the iron. Because the openings in the boot are not, in general, aligned with the openings in the sole of the iron, water spurting from the openings in the sole of the iron are captured between the boot and the sole of the iron where it is eventually vaporized by the heat of the iron.

Providing a ridge or ridges around the circumference of the boot cover further enhances the steam capturing effect of the cover. It has been found that providing these ridges results in a reduction in ironing friction over the device without these additional ridges, thereby allowing lower ironing effort by the person using the device and giving somewhat more even ironing.

While, in accordance with the patent statutes, there has been described what at present is considered to be preferred embodiment of the invention, it will be obvious to those skilled in the art that various changes and modificatons may be made therein without departing from the invention and it is, therefore, the aim of the appended claims to cover all such changes and modifications as fall within the truth spirit and scope of the invention.

What I claim as new and desire to be secured by Letters Patent of the United States of America is:

1. In a cover to be mounted on the underside of a steam iron having a sole, a nose and sides extending from the sole to provide the steam iron with improved characteristics for ironing heat-sensitive materials and being composed of any of the usual covering materials for said sole of the steam iron, the cover comprising:

a sheet boot material formed of one piece having a base portion and two peripheral side portions connected with said base portion, said base portion being coextensive with the sole and said side portions being adapted to cover a portion of the sides of the iron;

at least two first raised portions formed on opposite sides of the base portion of the material normally facing the sole of the iron to which the cover is to be attached to form at least one steam conduit with the sole of the iron when the cover is secured to the iron;

a first group of perforations formed in said material between said first raised portions;

second raised portions forming a partial ridge on said base portion facing the sole of the iron and forming additional steam conduits with said first raised portions;

said two peripheral side portions being of sufficient extent to be folded upwardly about the iron to which the cover is to be secured thereby to form rippled or wave-shaped sides which partially encase the edge of the iron joining the sides thereof to the sole;

the material from which said cover is formed having an enlarged front portion operable to form a front holding part adapted to be overlapped over the nose of the iron and secured together thereby forming a pocket for the use of the iron from the same material as said base portion;

said conduits being effective to keep the steam emitted from the steam iron on wanted places on the undersides of the cover; and, a spring operable to be secured to portions of the material and extend across the top of the iron whereby the material is secured to the iron;

said spring providing tension in the material whereby heat expansion of the material is compensated to provide for an even distribution of steam from the sole of the iron through said perforations for passage through said sheet boot material.

2. A cover as claimed in claim 1, including additional raised portions froming a second partial ridge substantially parallel to said first partial ridge and having at least some perforations formed in the material therebetween.

3. A cover as claimed in claim 1, including a second group of perforations formed in the material between said second raised portions.

4. A cover as claimed in claim 1, including two additional raised portions partially coextensive with said first-mentioned two raised portions and forming a steam conduit with each one of said first-mentioned two raised portions.

5. A cover as claimed in claim 1, 3, 4, wherein at least some of said perforations are formed in said raised portions.

6. A cover as claimed in claim 1, wherein said perforations are formed with collars which are shorter than the height of said raised portions whereby, when the cover is secured to the bottom of an iron, said collars are spaced from the sole of the iron and the perforations open into the steam conduit and are not sealed by the sole of the iron.

7. A cover as claimed in claim 6, wherein said collars are bevelled outwardly to enable quicker and more even distribution of heat.

8. A cover as claimed in claim 6, 7, wherein said perforations are formed in a side of said collar.

9. A cover as claimed in claim 1 or 2, wherein each said partial ridges have a substantially U-shaped configuration.

10. A cover as claimed in claim 1, including means for securing said overlapped portions together.

* * * * *